US012139824B2

(12) United States Patent
Jakobinski et al.

(10) Patent No.: US 12,139,824 B2
(45) Date of Patent: Nov. 12, 2024

(54) THREAD DRAW-OFF NOZZLE AND OPEN-END SPINNING DEVICE HAVING A THREAD DRAW-OFF NOZZLE

(71) Applicant: Saurer Spinning Solutions GmbH & Co. KG, Uebach-Palenberg (DE)

(72) Inventors: Andreas Jakobinski, Wegberg (DE); Sebastian Thomas, Moenchengladbach (DE)

(73) Assignee: Saurer Spinning Solutions Gmbh & Co. KG, Übach-Palenberg (DE)

( * ) Notice: Subject to any disclaimer, the term of this patent is extended or adjusted under 35 U.S.C. 154(b) by 0 days.

(21) Appl. No.: 18/327,950

(22) Filed: Jun. 2, 2023

(65) Prior Publication Data

US 2023/0392299 A1 Dec. 7, 2023

(30) Foreign Application Priority Data

Jun. 3, 2022 (DE) ..... 102022114064.4

(51) Int. Cl.
*D01H 13/04* (2006.01)
*D01H 4/10* (2006.01)

(52) U.S. Cl.
CPC ..... *D01H 13/045* (2013.01); *D01H 4/10* (2013.01)

(58) Field of Classification Search
CPC ..... D01H 4/08; D01H 4/40; D01H 13/045
USPC ..... 57/417
See application file for complete search history.

(56) References Cited

U.S. PATENT DOCUMENTS

| | | | |
|---|---|---|---|
| 3,458,987 | A | 8/1969 | Ozawa et al. |
| 3,501,907 | A | 3/1970 | Tabata et al. |
| 3,583,143 | A | 6/1971 | Guignard et al. |
| 3,604,194 | A | 9/1971 | Edagawa et al. |
| 3,722,198 | A | 3/1973 | Gotzfried |
| 3,742,692 | A | 7/1973 | Bense |
| 3,885,278 | A | 5/1975 | Whitaker |
| 3,910,021 | A | 10/1975 | Van Petten |
| 4,141,121 | A | 2/1979 | Trifunovic |
| 4,319,448 | A | 3/1982 | Jóźwicki et al. |
| 4,444,003 | A | 4/1984 | Götzfried |
| 4,509,321 | A | 4/1985 | Kajita et al. |
| 4,553,383 | A | 11/1985 | Didek et al. |
| 4,821,505 | A | 4/1989 | Jacobsen |

(Continued)

FOREIGN PATENT DOCUMENTS

| | | |
|---|---|---|
| CN | 209098877 U | 7/2019 |
| DE | 2304190 | 10/1973 |

(Continued)

*Primary Examiner* — Shaun R Hurley
(74) *Attorney, Agent, or Firm* — FLYNN THIEL, P.C.

(57) ABSTRACT

An open-end spinning device having a thread draw-off nozzle and a thread draw-off nozzle for an open-end spinning device, the thread draw-off nozzle having a thread-guiding surface which extends between an entry opening and a draw-off opening and which tapers in the shape of a funnel toward the draw-off opening. In order to provide a thread draw-off nozzle and an open-end spinning device having a thread draw-off nozzle which allows controlled production of the thread, the thread draw-off nozzle has a blocking element, which protrudes from the thread-guiding surface and which has a thread stop surface designed such that the thread stop surface blocks a thread from circulating over the thread-guiding surface.

16 Claims, 2 Drawing Sheets

(56) References Cited

U.S. PATENT DOCUMENTS

| | | | | |
|---|---|---|---|---|
| 4,932,202 | A * | 6/1990 | Landwehrkamp | D01H 4/40 57/414 |
| 5,086,615 | A | 2/1992 | Bodnar | |
| 5,423,177 | A * | 6/1995 | Raasch | D01H 4/40 57/417 |
| 5,461,757 | A | 10/1995 | Leifeld | |
| 5,934,058 | A | 8/1999 | Hirao et al. | |
| 6,035,625 | A * | 3/2000 | Schlomer | D01H 4/40 57/352 |
| 6,067,786 | A | 5/2000 | Schmid | |
| 6,269,623 | B1 * | 8/2001 | Phoa | D01H 4/40 57/417 |
| 6,314,714 | B1 | 11/2001 | Feuerlohn et al. | |
| 6,347,506 | B1 * | 2/2002 | Backmeister | D01H 4/40 57/417 |
| 6,389,789 | B1 * | 5/2002 | Preininger | D01H 4/40 57/352 |
| 2002/0046558 | A1 * | 4/2002 | Lovas | D01H 4/08 57/406 |
| 2002/0124543 | A1 | 9/2002 | Bischofberger et al. | |
| 2002/0152739 | A1 | 10/2002 | Anderegg | |
| 2003/0115850 | A1 | 6/2003 | Stalder et al. | |
| 2003/0121247 | A1 | 7/2003 | Stalder et al. | |
| 2004/0261391 | A1 | 12/2004 | Stalder et al. | |
| 2005/0011178 | A1 * | 1/2005 | Weide | D01H 4/40 57/417 |
| 2005/0229580 | A1 * | 10/2005 | Baur | D01H 4/40 57/417 |
| 2005/0233021 | A1 | 10/2005 | Chun et al. | |
| 2009/0094958 | A1 | 4/2009 | Weide et al. | |
| 2011/0315265 | A1 * | 12/2011 | Schermer | D01H 4/40 139/435.1 |
| 2015/0337463 | A1 * | 11/2015 | Stahlecker | D01H 4/40 57/346 |
| 2016/0010245 | A1 * | 1/2016 | Stahlecker | D01H 4/40 57/417 |
| 2016/0376731 | A1 * | 12/2016 | Winzen | D01H 4/40 57/417 |
| 2017/0314166 | A1 | 11/2017 | D'Agnolo et al. | |
| 2017/0342605 | A1 * | 11/2017 | Loos | D01H 4/40 |
| 2018/0030624 | A1 * | 2/2018 | Baier | D01H 4/22 |
| 2018/0320292 | A1 * | 11/2018 | Baur | D01H 4/10 |
| 2018/0320293 | A1 * | 11/2018 | Baur | D01H 4/10 |
| 2019/0100861 | A1 | 4/2019 | Maleck et al. | |
| 2020/0131673 | A1 | 4/2020 | D'Agnolo et al. | |
| 2021/0198810 | A1 | 7/2021 | Lozano et al. | |
| 2022/0195634 | A1 | 6/2022 | Meissner et al. | |
| 2023/0016597 | A1 | 1/2023 | Günther et al. | |
| 2023/0115870 | A1 | 4/2023 | Kistner et al. | |
| 2023/0407530 | A1 | 12/2023 | Chen et al. | |
| 2024/0026576 | A1 | 1/2024 | Sendler et al. | |
| 2024/0026577 | A1 | 1/2024 | Dressen et al. | |

FOREIGN PATENT DOCUMENTS

| | | | |
|---|---|---|---|
| DE | 3913215 | A1 | 11/1989 |
| EP | 2677070 | A1 | 12/2013 |
| EP | 3012362 | A2 | 4/2016 |
| JP | S58-81625 | A | 5/1983 |

* cited by examiner

THREAD DRAW-OFF NOZZLE AND OPEN-END SPINNING DEVICE HAVING A THREAD DRAW-OFF NOZZLE

CROSS-REFERENCE TO RELATED APPLICATION

This claims priority from Germany Application No. 102022114064.4, filed Jun. 3, 2022, the disclosure of which is hereby incorporated by reference in its entirety.

FIELD OF THE INVENTION

The present invention relates to an open-end spinning device having a thread draw-off nozzle and to a thread draw-off nozzle for an open-end spinning device, the thread draw-off nozzle having a thread-guiding surface which extends between an entry opening and a draw-off opening and which tapers in the shape of a funnel toward the draw-off opening.

BACKGROUND OF THE INVENTION

In the production of threads in accordance with the open-end rotor spinning method, the thread, which is formed from fibres fed into a rotor groove of a spinning rotor, is drawn off from the interior of the rotor via the draw-off nozzle. As a result of the rotation of the rotor, the thread leg extending between the rotor groove and the draw-off nozzle twists and gives the thread a real twist.

Furthermore, the thread also continuously circulates over the entire periphery of the draw-off nozzle on the thread-guiding surface in the peripheral direction during the draw-off movement. As the thread circulates, the thread rolls over the thread-guiding surface with slip, resulting in a false twist of the thread. Because of the continuous circulation of the thread on the thread-guiding surface, the thread crosses, at regular intervals, the region in which fibres are introduced into the spinning rotor, causing belly bands which reduce the quality of the thread. Thus, the thread characteristics result from random contact of the thread with the thread-guiding surface of the thread draw-off nozzle and are not the result of targeted setting. The continuous circulation of the thread over the entire thread-guiding surface and the accompanying circulation of the thread draw-off point at the rotor groove also cause, during the thread production, a spatial use extending over the entire circumference of the rotor.

Proceeding therefrom, the problem addressed by the present invention is that of providing a thread draw-off nozzle and an open-end spinning device having a thread draw-off nozzle which allows controlled production of the thread.

SUMMARY OF THE INVENTION

In known open-end spinning devices, as the point of detachment of the thread from the rotor groove circulates in the circumferential direction of the rotor groove, the thread leg extending from the rotor groove to the thread draw-off nozzle also travels in the peripheral direction on the thread-guiding surface of the draw-off nozzle. To limit this circulation of the thread on the thread-guiding surface, the thread draw-off nozzle has a blocking element protruding from the thread-guiding surface. The blocking element has a thread stop surface designed such that the thread stop surface blocks the circulation of the thread over the thread-guiding surface as the thread is being drawn off. Thus, during the draw-off movement the thread slides along the thread stop surface of the blocking element in the region between the entry opening near the rotor groove and the draw-off opening remote from the rotor groove. Because the thread is prohibited from circulating on the thread-guiding surface, false twist of the thread is prevented in an effective way. The thread characteristics can be set in a targeted way by virtue of an individual design of the contour of the thread-guiding surface, e.g. its funnel-shaped course from the entry opening to the draw-off opening; this concerns, inter alia, the hairiness and the twist of the thread.

Furthermore, in accordance with the orientation of the thread draw-off nozzle with the blocking element in relation to the orientation of the entry of the fibres into the spinning rotor, an angular region having no influence on the production of the thread is created within the rotor. The region, which—with respect to the direction of rotation of the spinning rotor—extends from the blocking element to the region of the fibre feed-in, is therefore available as free installation space which can be used e.g. for a rotor cleaning unit. In addition, by blocking the circulation of the thread, the blocking element prevents crossing of the thread with the fibre entry, and thus the formation of belly bands on the drawn-off thread, which could possibly accompany such crossing, is prevented.

In principle, the design of the blocking element, which has the thread stop surface that blocks the circulation of the thread, can be freely selected. According to an advantageous embodiment herein, however, the blocking element has a ridge-type protrusion extending in the longitudinal axis direction of the thread draw-off nozzle. In this embodiment, the blocking element has, or is formed by, a protrusion which extends in a straight line on the thread-guiding surface in the longitudinal axis direction of the thread draw-off nozzle, wherein the longitudinal axis extends through the centre point of the entry opening and the centre point of the draw-off opening of the thread draw-off nozzle, which is usually rotationally symmetric. This embodiment ensures that the thread is reliably guided over the thread-guiding surface along the thread stop surface of the ridge-type protrusion. Disruptions in the running of the thread over the thread draw-off nozzle are thereby particularly reliably prevented.

According to a particularly advantageous embodiment, the protrusion has a thread stop surface which extends at a right angle to the thread-guiding surface. A corresponding design of the thread stop surface ensures, to an additional extent, flawless running of the thread along the protrusion. The thread is prevented, in an effective way, from getting stuck or from jumping over the protrusion. Also, a corresponding protrusion can be particularly easily and economically arranged on the thread-guiding surface.

According to another embodiment, the thread-guiding surface has, in the region of the entry opening, an end portion which is curved in the peripheral direction. The curved end portion improves the running of the thread along the blocking element, the end portion can be designed in accordance with the course of the thread leg formed between the rotor groove and the thread draw-off nozzle. Disruptions in the drawing off of the thread from the spinning rotor are particularly advantageously prevented by a corresponding design of the end portion.

The blocking element can extend over the entire region between the entry opening and the draw-off opening. It is also possible that the blocking element extends—with respect to the longitudinal axis direction of the thread draw-off nozzle—between the entry opening and a central region of the thread-guiding surface. According to another embodiment, the blocking element and the thread draw-off nozzle are formed as a single piece. A thread draw-off nozzle of this type can be produced by an injection-moulding process, in which case the mould can be separated in the longitudinal axis direction of the thread draw-off nozzle along the thread stop surface of the blocking element. In the case of such a single-piece design, the production is simplified if the blocking element extends in the longitudinal axis direction of the thread draw-off nozzle over the entire region between the entry opening and the draw-off opening. The blocking element and the thread draw-off nozzle can also be produced separately and subsequently joined. The individual parts can be produced more easily than in the case of the single-piece design.

According to another embodiment, the thread stop surface has a profile. The profile can be produced by virtue of a defined surface roughness or by the introduction of notches or the like into the thread stop surface. The thread properties can be set in a defined way by the design of the profile.

An embodiment as presented herein also solves the problem by an open-end spinning device in which the thread-guiding surface of the thread draw-off nozzle has a blocking element, which protrudes from the thread-guiding surface and which has a thread stop surface designed such that the thread stop surface blocks a thread from circulating over the thread-guiding surface. The open-end spinning device ensures not only reliable production of a thread with defined properties but also a free installation space in accordance with the orientation of the thread draw-off nozzle in relation to the fibre introduction, which free installation space can be used for supplementary units, such as a rotor cleaning unit.

BRIEF DESCRIPTION OF THE DRAWINGS

An embodiment example of the present invention is shown below in the drawings. In the drawings.

DETAILED DESCRIPTION

Figure 1:
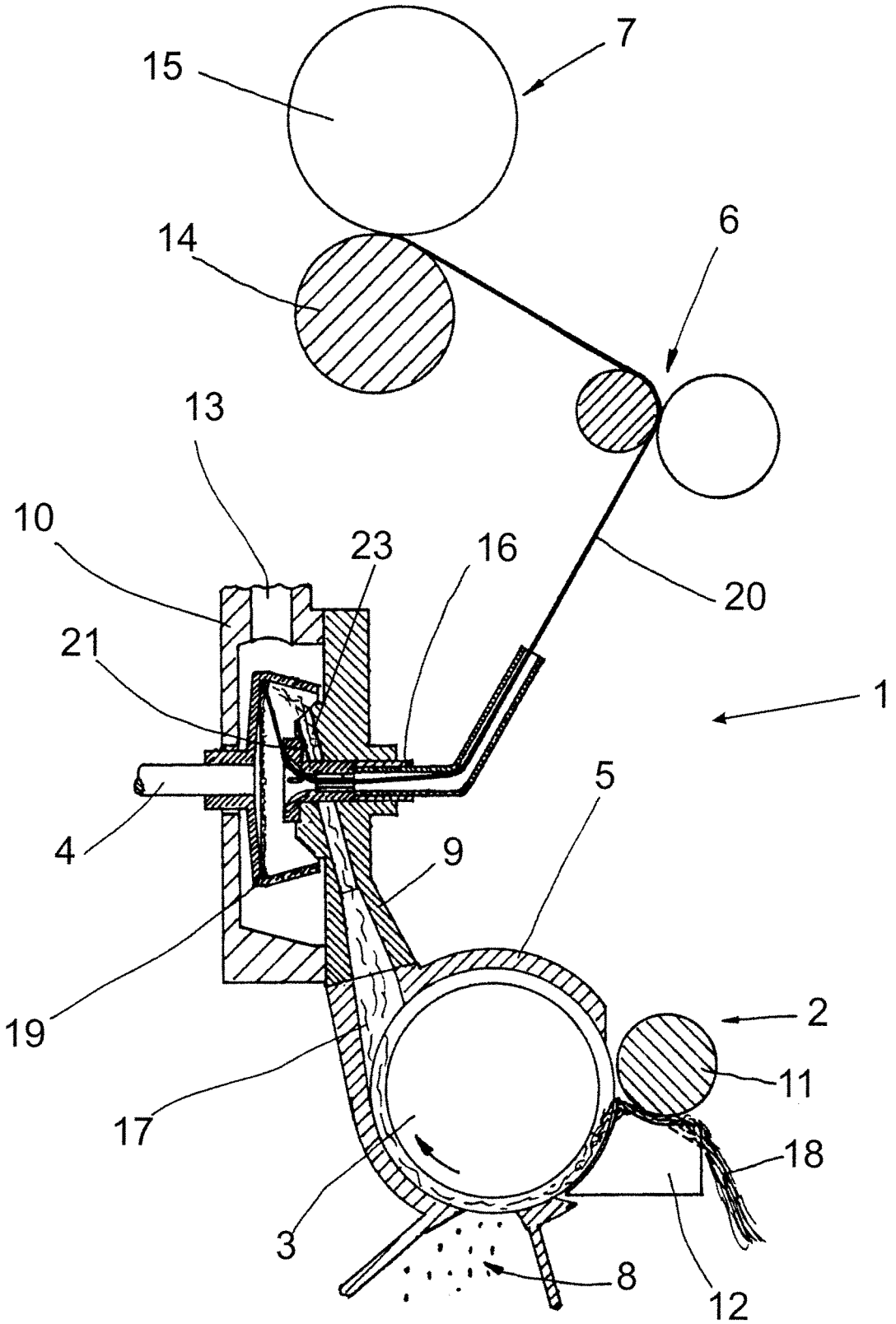
FIG. 1 shows an open-end spinning device schematically in cross-section.

According to FIG. 1, an open-end spinning device 1 comprises, as essential elements, a feeding device 2, an opening device in the form of an opening roller 3, a spinning element in the form of a spinning rotor 4, a thread draw-off device in the form of a thread draw-off roller pair 6, and a thread winding device 7. The feeding device 2 has a feed roller 11, with which a feed tray 12 elastically cooperates. The opening roller 3 of the opening device is mounted in a housing 5, which, in the embodiment example shown, has a dirt separation opening 8 in its peripheral wall. With respect to the fibre transport direction, a fibre feed channel 9 extending into the spinning rotor 4 begins following the dirt separation opening 8. The spinning rotor 4 is arranged in a housing 10, which is connected to a negative pressure source (not shown) by a negative pressure line 13 so that a negative spinning pressure is produced. The thread wind-up device 7 has a winding roller 14, by which a bobbin 15 is driven. A thread draw-off channel 16 extends into the housing 10.

During the production, a sliver 18 is fed to the opening roller 3 via the feed tray 12 by the feed roller 11. The opening roller 3 opens the sliver 18 into individual fibres 17. The fibres 17 are brought into the rotor groove 19 of the spinning rotor 4 via a fibre feed-in line 23 by the negative spinning pressure and from there are drawn off as a thread 20 via the thread draw-off nozzle 21 and the thread draw-off channel 16 by a thread draw-off roller pair 6 and conveyed to the winding device 7.

The thread end of the thread 20 being drawn off from the rotor groove 19 actually wants to rotate like a crank around the thread draw-off nozzle axis, which is (essentially) identical to the rotor axis. But this thread end is prevented from calmly sweeping over a funnel-shaped thread-guiding surface 28 of the draw-off nozzle 21 by a blocking element 22.

Figure 2:
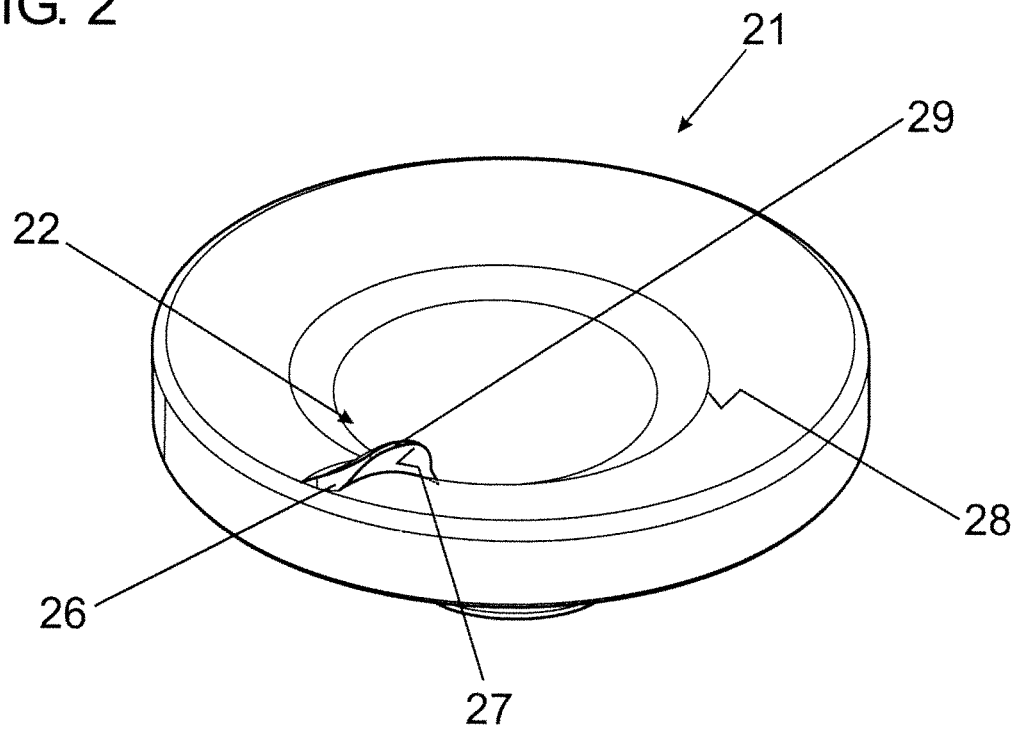
FIG. 2 shows a perspective view of a draw-off nozzle having a blocking element.
Figure 3:
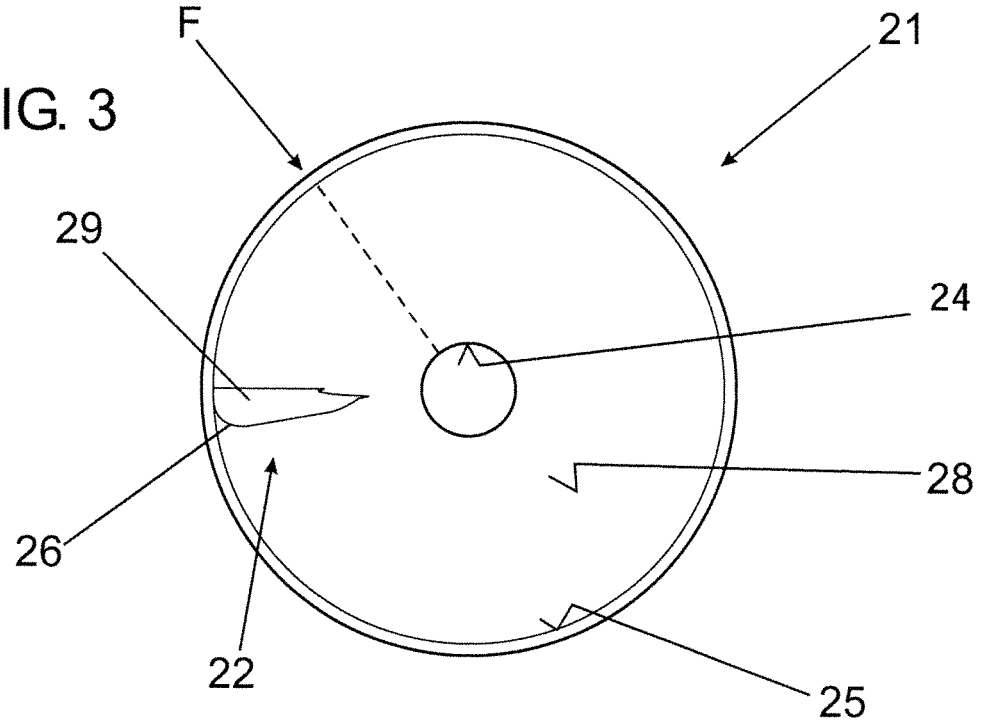
FIG. 3 shows a top view of the thread draw-off nozzle of FIG. 2.

In the thread draw-off nozzle 21 shown in FIGS. 2 and 3, the blocking element 22 has a ridge-type protrusion 29, which extends in the longitudinal axis direction of the thread draw-off nozzle and a thread stop surface 27 of which protrudes at a right angle from the thread-guiding surface 28 extending from the entry opening 25 to the draw-off opening 24. The thread stop surface 27 prevents circulation of the thread 20 drawn off from the rotor groove 19; the thread 20 slides on the thread stop surface 27 while being drawn off from the spinning rotor 4.

In FIG. 3, the blocking element 22 extends in the longitudinal axis direction of the thread draw-off nozzle 21 between the entry opening 25 and a central region of the thread-guiding surface 28. According to an alternative which is not shown, it is also possible that the blocking element 22 extends in the longitudinal axis direction of the thread draw-off nozzle 21 over the entire region between the entry opening 25 and the draw-off opening 24.

In the region of the entry opening 25, the protrusion 29 is curved in an end portion 26, the curvature being directed in the direction of rotation of the spinning rotor 4, so that the thread 20 is guided trouble-free over the end portion 26 along the thread stop surface 27.

When the fibres 17 are fed in via the fibre feed-in line 23 in the fibre feed-in region F shown in FIG. 3, a free region is created in the spinning rotor 4. This free region extends in the circumferential direction between the blocking element 22 and the fibre feed-in region F, and in this free region the spinning rotor 4 enters into operative connection neither with the fed-in fibres 17 nor with the drawn-off thread 20. Thus, this region can be used for supplementary units (not shown here), such as a rotor cleaning unit.

LIST OF REFERENCE SIGNS

1 Open-end spinning device
2 Feeding device
3 Opening roller
4 Spinning rotor
5 Housing
6 Thread draw-off roller pair
7 Thread winding device
8 Dirt separation opening
9 Fibre feed channel
10 Housing
11 Feed roller
12 Feed tray
13 Negative pressure line
14 Winding roller
15 Bobbin
16 Thread draw-off channel
17 Fibres
18 Sliver
19 Rotor groove
20 Thread
21 Thread draw-off nozzle

22 Blocking element
23 Fibre feed-in line
24 Draw-off opening
25 Entry opening
26 End portion
27 Thread stop surface
28 Thread-guiding surface
29 Protrusion
F Fibre feed-in

The invention claimed is:

1. A thread draw-off nozzle for an open-end spinning device, comprising:

a thread-guiding surface which extends between an entry opening and a draw-off opening and which tapers in a shape of a funnel toward the draw-off opening; and a blocking element which protrudes from the thread-guiding surface and which has a thread stop surface designed such that the thread stop surface blocks a thread to prevent the thread from passing over the thread stop surface and circulating over the thread-guiding surface.

2. The thread draw-off nozzle according to claim 1, wherein the blocking element has a ridge-type protrusion extending in a longitudinal axis direction of the thread draw-off nozzle.

3. The thread draw-off nozzle according to claim 2, wherein the ridge-type protrusion has a thread stop surface which extends at a right angle to the thread-guiding surface.

4. The thread draw-off nozzle according to claim 1, wherein the thread-guiding surface has, in a region of the entry opening, an end portion which is curved in a peripheral direction.

5. The thread draw-off nozzle according to claim 1, wherein the blocking element extends in a longitudinal axis direction of the thread draw-off nozzle over an entire region between the entry opening and the draw-off opening.

6. The thread draw-off nozzle according to claim 1, wherein the blocking element extends in a longitudinal axis direction of the thread draw-off nozzle between the entry opening and a central region of the thread-guiding surface.

7. The thread draw-off nozzle according to claim 1, wherein the blocking element and the thread draw-off nozzle are formed as a single piece.

8. The thread draw-off nozzle according to claim 1, wherein the thread stop surface has a profile.

9. An open-end spinning device, comprising:

a thread draw-off nozzle which has a thread-guiding surface which extends between an entry opening and a draw-off opening and which tapers toward the draw-off opening;

wherein the thread-guiding surface has a blocking element which protrudes from the thread-guiding surface and which has a thread stop surface designed such that the thread stop surface blocks a thread to prevent the thread from passing over the thread stop surface and circulating over the thread-guiding surface.

10. The open-end spinning device according to claim 9, wherein the blocking element has a ridge-type protrusion extending in a longitudinal axis direction of the thread draw-off nozzle.

11. The open-end spinning device according to claim 10, wherein the ridge-type protrusion has a thread stop surface which extends at a right angle to the thread-guiding surface.

12. The open-end spinning device according to claim 9, wherein the thread-guiding surface has, in a region of the entry opening, an end portion which is curved in a peripheral direction.

13. The open-end spinning device according to claim 9, wherein the blocking element extends in a longitudinal axis direction of the thread draw-off nozzle over an entire region between the entry opening and the draw-off opening.

14. The open-end spinning device according to claim 9, wherein the blocking element extends in a longitudinal axis direction of the thread draw-off nozzle between the entry opening and a central region of the thread-guiding surface.

15. The open-end spinning device according to claim 9, wherein the blocking element and the thread draw-off nozzle are formed as a single piece.

16. The open-end spinning device according to claim 9, wherein the thread stop surface has a profile.

* * * * *